United States Patent [19]

Knapp, Jr.

[11] 4,156,224

[45] May 22, 1979

[54] CAPACITOR FUSE

[75] Inventor: Edward J. Knapp, Jr., Merrimac, Mass.

[73] Assignee: Gould Inc., Rolling Meadows, Ill.

[21] Appl. No.: 865,611

[22] Filed: Dec. 29, 1977

[51] Int. Cl.[2] ..... H01H 85/02

[52] U.S. Cl. ..... 337/187; 337/201; 337/252

[58] Field of Search ..... 337/187, 188, 197, 201, 337/251, 252, 248

[56] References Cited

U.S. PATENT DOCUMENTS 4,012,708 3/1977 Goe ..... 337/248 X

FOREIGN PATENT DOCUMENTS 28872 of 1912 United Kingdom ..... 337/251

*Primary Examiner*—George Harris
*Attorney, Agent, or Firm*—Erwin Salzer

[57] ABSTRACT

An electric fuse is closed by a pair of ferrules or caps which engage the lateral surfaces of the casing and have end surfaces provided with a relatively large, circular, concentric bore. The fuse further includes a pair of rods generally hexagonal in cross-section, each having an end portion circular in cross-section, substantially equal in diameter to the diameter of said bore in each of said pair of caps and inserted into said bore.

1 Claim, 4 Drawing Figures

CAPACITOR FUSE

BACKGROUND OF THE INVENTION

Capacitor fuses are often provided with rods hexagonal in cross-section which project in opposite directions from the casing of the fuse and serve to hold the fuse by means of a wrench while it is mounted on a capacitor, or removed from it. The length of these hexagonal rods varies, depending on the particular capacitor and on the particular application of the capacitor fuse. Up to the present, as many different fuses having the same voltage rating and current rating had to be manufactured as the number of different hexagonal connecting rods required.

It is the prime object of the present invention to provide standard fuses—one for each voltage rating and current rating—which are of simple design and which can readily be provided with hexagonal connecting rods of any desired length.

SUMMARY OF THE INVENTION

Fuses embodying this invention comprise, in addition to a casing of electric insulating material, a pair of terminal elements closing the ends of said casing, at least one fusible element conductively interconnecting said pair of terminal elements, and a pulverulent arc-quenching filler. Said pair of terminal elements are in the shape of caps whose lateral surfaces engage the lateral surfaces of said casing. The end surfaces of said pair of caps are each provided with a relatively large circular bore. A pair of rods generally hexagonal in cross-section has axially inner ends each circular in cross-section and each inserted into said bore of said cap and projecting into said pulverulent arc-quenching filler.

DESCRIPTION OF PREFERRED EMBODIMENTS

Figure 1:
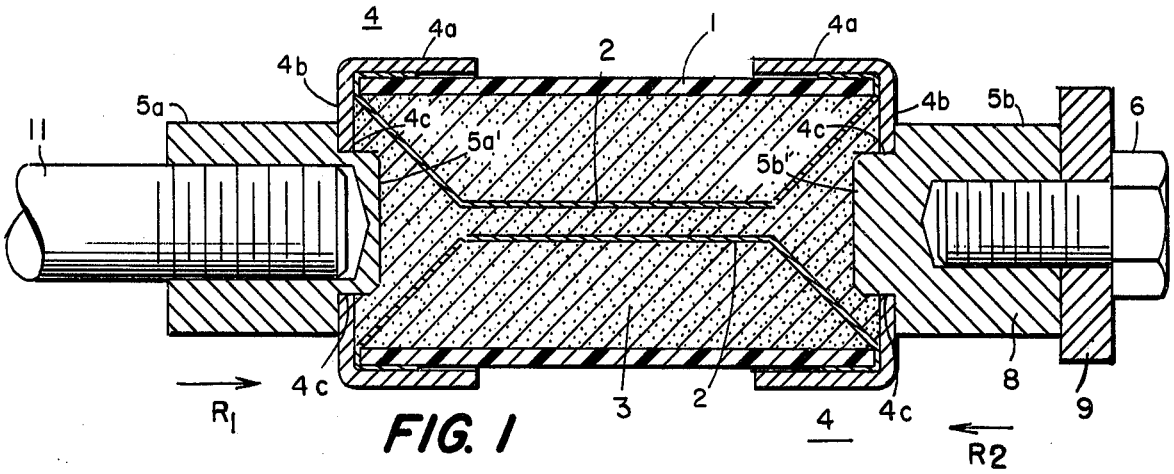
FIG. 1 is substantially a longitudinal section of a fuse embodying the present invention.
Figure 2:
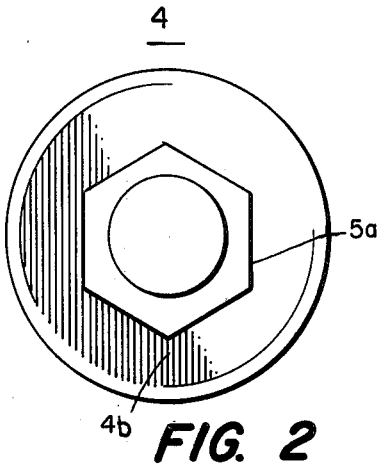
FIG. 2 is an end view of the fuse of FIG. 1 seen in the direction of arrow $R_1$ of FIG. 1.
Figure 3:
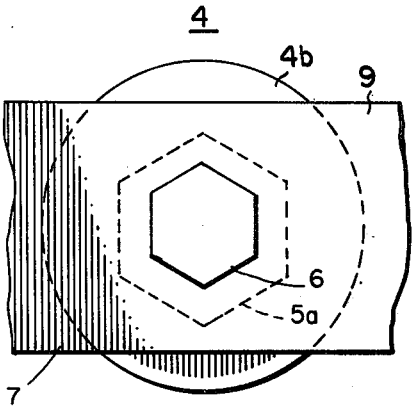
FIG. 3 is an end view of the fuse of FIG. 1 seen in the direction of arrow $R_2$ of FIG. 1.

In the drawings reference numeral 1 has been applied to indicate a tubular casing of electric insulating material, e.g. glass-cloth-melamine. A pair of fusible elements 2 is arranged substantially parallel to the wall of casing 1, and bent over the rims of casing 1 to the outer surface thereof. Each fusible element 2 subdivides the current path of the fuse into a plurality of parallel current paths. Casing 1 is filled with a pulverulent arc-quenching filler 3, e.g. quartz sand. The terminal caps 4 are mounted on the ends of casing 1 and each comprises a lateral portion **4*a* engaging the lateral surface of casing 1, and an annular end surface 4*b* which defines a relatively large concentric circular bore 4*c*. Each of rods 5*a*,5*b* is hexagonal in cross-section so that it can readily be handled by a wrench, but each rod 5*a*,5*b* has an end portion 5*a*′,5*b*′ annular in cross-section and substantially equal in diameter to the diameter of said bore 4*c* in each of caps 4, and inserted into said bore 4*c*. Both rods 5*a*,5*b* have an internally screw-threaded bore extending in a direction longitudinally thereof. The thread in one of rods 5*a* may be used to mount the fuse on rod 11 which is externally screw-threaded and forms part of a capacitor (not shown). The internal thread in the other rod 8 may be used for insertion of a screw 6 for clamping down a bus bar 9**, or the like.

The end portions **5*a*′,5*b*′ of cylindrical cross-sections of rods 5*a*,5*b* project a predetermined distance into casing 1 to compress the arc-quenching filler 3 therein. Thus rods 5*a*,5*b* are in effect dual function parts, i.e. connectors and compressors for the pulverulent arc-quenching filler 3**.

Figure 4:
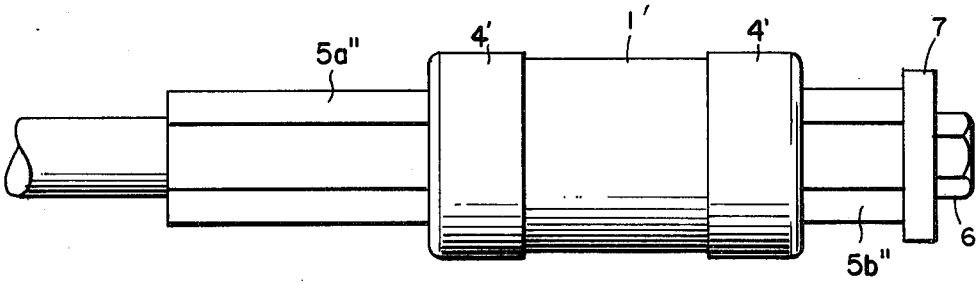
FIG. 4 is a side elevation of a fuse having hexagonal rods of a length that differs from the length of the rods shown in FIG. 1.

Rods **5*a*,5*b* may be secured to caps or ferrules 4, e.g. by brazing. The length of rods 5*a*,5*b* may be varied depending upon instant requirements. Thus FIG. 4 shows a casing 1′ of smaller size than casing 1 closed by caps 4′ smaller than caps 4. Rod 5*a*″ is considerably longer than rod 5*a* and rod 5*b* and thinner and shorter than rod 5*b*. The apertures in caps 4 and 4′** may, however, be of the same size.

I claim as my invention:

1. An electric fuse for capacitors comprising a tubular casing of electric insulating material, a pair of terminal elements closing the ends of said casing, at least one fusible element conductively interconnecting said pair of terminal elements, and a pulverulent arc-quenching filler inside said casing embedding said fusible element wherein the novel feature consists in a pair of terminal elements in the shape of cylindrical caps whose lateral surfaces overlap the outer lateral surfaces of said casing and whose end surfaces are each provided with a relatively large concentric circular bore, and in a pair of rods generally hexagonal in cross-section each having an axially inner end portion circular in cross-section substantially equal in diameter to the diameter of said bore in each of said pair of caps and inserted into said bore and projecting into said pulverulent arc-quenching filler.

* * * * *